US005462475A

United States Patent [19]

Kennedy

[11] Patent Number: 5,462,475

[45] Date of Patent: Oct. 31, 1995

[54] BLOCKING SYSTEM FOR PRESCRIPTION LENSES

[75] Inventor: Brian H. Kennedy, Charlottesville, Va.

[73] Assignee: National Optronics, Inc., Charlottesville, Va.

[21] Appl. No.: 16,940

[22] Filed: Feb. 12, 1993

[51] Int. Cl.[6] ..... B24B 41/06

[52] U.S. Cl. ..... 451/384; 451/460; 451/385; 451/390; 451/42

[58] Field of Search ..... 451/216 LP, 217 L, 451/216 T, 216 P, 125, 277, 284 R, 42, 384, 390, 391, 402, 460, 278, 365, 385, 397

[56] References Cited

U.S. PATENT DOCUMENTS

| | | | |
|---|---|---|---|
| 2,151,233 | 3/1939 | Rowe | 51/216 |
| 2,660,011 | 11/1953 | Bernheim et al. | 51/277 |
| 2,688,220 | 9/1954 | Boutell | 51/235 |
| 2,752,738 | 7/1956 | Seifert | 51/195 |
| 2,982,061 | 5/1961 | Dillon | 51/277 |
| 3,118,198 | 1/1964 | Prunier | 22/202 |
| 3,152,427 | 10/1964 | Prunier | 51/216 LP |
| 3,192,676 | 7/1965 | Buckminster | 51/216 |
| 3,262,233 | 7/1966 | Schrier | 51/281 |
| 3,404,488 | 10/1968 | Cox et al. . | |
| 3,886,696 | 6/1975 | Brück | 51/216 LP |
| 3,962,833 | 6/1976 | Johnson | 51/284 |
| 4,158,273 | 6/1979 | Olsen et al. | 51/284 R |
| 4,221,083 | 9/1980 | Carroll | 51/284 R |
| 4,459,784 | 7/1984 | Hernandez et al. | 51/216 LP |

FOREIGN PATENT DOCUMENTS

| | | |
|---|---|---|
| 996287 | of 0000 | France . |
| 2366010 | 9/1977 | Germany . |
| 3934180 | 4/1990 | Germany . |
| 1262489 | 2/1972 | United Kingdom . |

*Primary Examiner*—Bruce M. Kisliuk
*Assistant Examiner*—Eileen P. Morgan
*Attorney, Agent, or Firm*—Joseph W. Berenato, III

[57] ABSTRACT

An adhesive blocking system, for generating and for fining and polishing eyeglass lenses, utilizes a collar which slides over and engages a lens block, which lens block is secured to a lens blank by a relatively thick adhesive pad, to uniformly transfer pressure from the cylinder machine to the lens blank without deforming the adhesive pad, which deformation adversely affects the optics. In this manner, a lens blank is blocked only once for both generating and fining and polishing. In addition, the environmental risks and heating effects of current solder blocking systems are avoided.

4 Claims, 2 Drawing Sheets

FIG. 2B
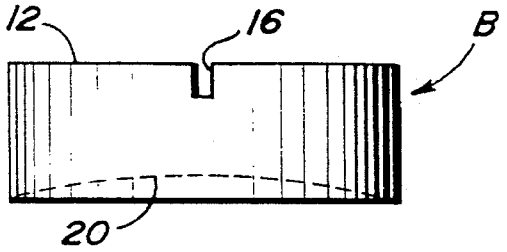
FIG. 2A
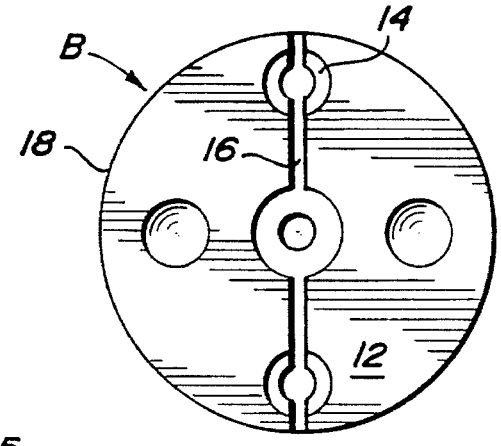
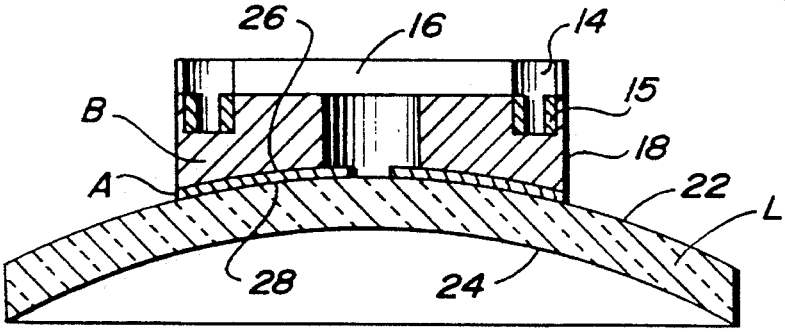
FIG. 3
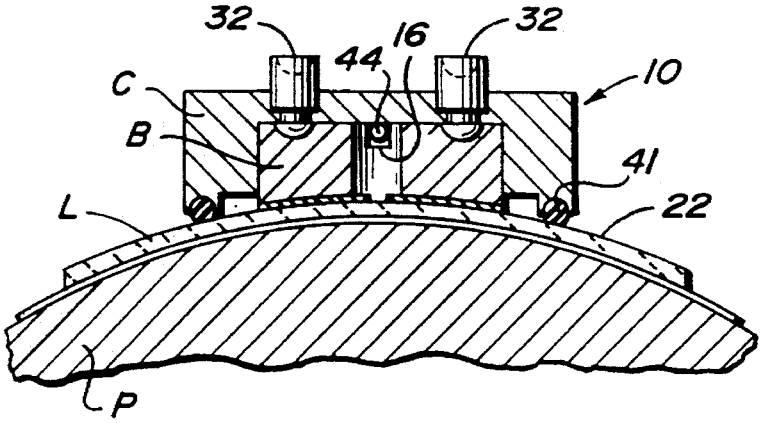
FIG. 1

BLOCKING SYSTEM FOR PRESCRIPTION LENSES

FIELD OF THE INVENTION

The present invention relates to the blocking of optical lenses for fining and polishing.

BACKGROUND OF THE INVENTION

Prescription eyeglass lenses are often supplied to an optical laboratory in the form of a plastic blank. The blank is sized in diameter and thickness to be used in a large variety of eyeglass frames and for a large variety of prescriptions. Therefore, before the eyeglasses can be delivered to the customer, the optical laboratory must grind or generate the base and cross curves onto the back of the lens blank, fine and polish the generated surface of the lens blank to optical clarity, and edge the lens blank to the configuration necessary for the particular eyeglass frame chosen by the customer.

The grinding, polishing, and edging operations are performed on machine tools which may be either manually or numerically controlled. It is necessary to position the lens blank during these processes, and the most common method of holding the lens is with a circular block secured to the front face of the blank. A lead solder may be used because of its low melting point (117° –121° F.), speed in setting up, ease in deblocking, ease in reclaiming the alloy, and solid stability during the process.

While this system is commonly used, it suffers from several drawbacks. Even though the solder has a relatively low melting point, the heat can cause problems with some lens materials. For this reason, the plastic lenses are first covered with a tape prior to blocking. In addition, while the alloy may be reclaimed, that requires additional steps, time, and processing equipment. Furthermore, this alloy system poses environmental problems. The alloy not only contains lead, but also cadmium. Heavy metals may pose health risks to employees handling them and breathing their fumes, as well as a risk to the environment, particularly in the disposal of the water used in the reclaiming tank.

Alternative methods of securing the block to the lens blank, such as with the use of a double-sided adhesive pad, are known. While these adhesive pads overcome of many of the environmental and health concerns, several problems still exist. The appropriate adhesive must exhibit a high resistance to torque because the lens blank is rotated on its geometric axis during the various generating and finishing processes. At the same time, however, the adhesive must have a low resistance to shear, because lab personnel must be able to remove the block and adhesive pad from the finished lens blank. In addition, the adhesive itself must be easily removed with solvents which will not harm the lens blank.

Another more critical problem with an adhesive pad is its susceptibility to deformation during the generating, fining, and polishing processes. During generation, the block is held in a collet and rotated while a cutting tool is brought into contact with the lens blank. To hold the lens on axis, chuck centering pins engage holes in the block. In contrast, during fining and polishing, pins extending from the cylinder machine engage holes in the lens block for moving the generated lens over a lap. The pressure of the tool and the lap against the lens blank may cause relative movement between the lens blank and the block because of the deformable nature of the adhesive pad. This relative motion, particularly when the pad becomes wet, may adversely affect the optics of the lens.

SUMMARY OF THE INVENTION

Generally speaking, this invention fulfills the above-described needs in the art by providing a collar for use in fining and polishing a lens which comprises a cylindrical body having first and second oppositely disposed faces and a circumferential wall extending between these faces, a plurality of pressure contacts operatively associated with the first face for engaging a plurality of cylinder machine pressure pins, a well opening on the second face for receiving a lens block therein, and an edge extending from the second face and having a surface for contacting a face of a lens secured to a lens block received within the well.

Preferred embodiments of the invention include a means for engaging cooperating means of a lens block so that axial stability of the lens block is maintained.

Another preferred embodiment of the invention further comprises an O-ring extending from the contacting surface of the collar for contacting a face of a lens.

A system for holding a lens blank, comprises a lens block, a pad having adhesive applied to opposite sides of the pad for securing the block to a lens blank, and a collar for receiving and engaging the lens block having a lens blank secured thereto.

A system for holding a lens blank, comprises a circular polymeric block having first and second oppositely disposed faces, the first face having a nominal base curve for securing a lens blank thereto, the second face including a diametrically extending slot opening on the second face and on the periphery of the block, a circular collar having first and second oppositely disposed surfaces, the first surface including a plurality of diametrically opposed inserts extending perpendicularly therefrom, the second surface including an O-ring extending therefrom proximate the periphery of the collar for contacting the face of a lens blank and a centrally located well for receiving the block, and a roll pin disposed proximate the back of the well for engaging the slot to maintain axial stability of the block.

A lens block for use in finishing a lens blank, comprises a cylindrical element having first and second oppositely disposed faces, a nominal base curve disposed in the first face for securing a lens blank thereto using a double-coated adhesive pad, a plurality of generating pin locating holes disposed in the second face, and means for engaging cooperative engagement means of a collar so that axial stability between the element and the collar is maintained without pressure being applied to said element by said collar.

These and other features and advantages of the invention will be readily apparent in view of the following description and drawings of the above-described invention.

BRIEF DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a cross sectional view of the blocking system of the present invention secured to fragment of a lens blank as set up for use in the fining/polishing operation.

FIG. 2*a* is a top plan view of the lens block of the invention.

FIG. 2*b* is a side elevational view with portions shown in phonton of the lens block of FIG. 2*a*.

FIG. 3 is a cross sectional view of a blocked lens blank.

DETAILED DESCRIPTION OF THE INVENTION

Figure 4A:
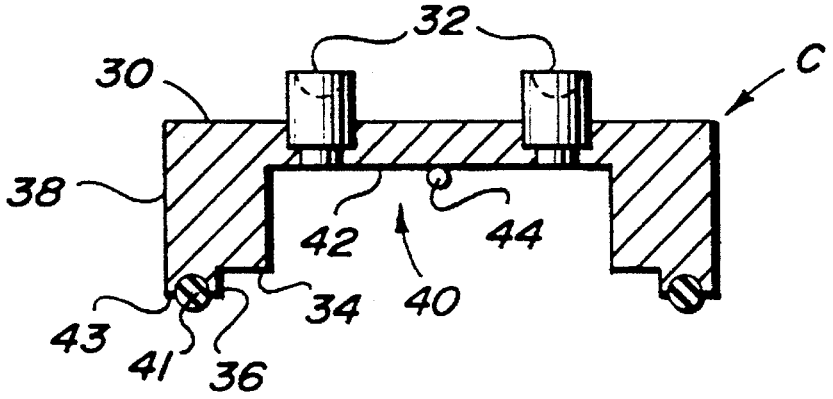
FIG. 4*a* is a cross sectional view of the fining/polishing collar of the present invention.

With reference now to FIG. 1, the system for holding a lens blank is shown generally at 10 as it would be set up for the fining and polishing steps of manufacturing prescription lenses. System 10 includes lens block B adhesively secured to lens blank L, with fining/polishing collar C surrounding and engaging block B.

Lens block B, as best shown in FIGS. 2*a* and 2*b*, is a cylindricl plastic block having oppositely disposed faces. First face 12 is a planar surface. Two diametrically opposed generator pin locating holes 14 are formed in surface 12 and extend inwardly therefrom in parallel, parallel to the axis of block B. Each of holes 14 contains a metal insert 15 as best shown in FIG. 3, to protect block B from excessive wear. Pin slot 16 extends across face 12 through holes 14 and opens on circumferential edge 18 of block B. Slot 16 extends into block B to a depth intermediate that to which holes 14 extend.

As best shown in FIG. 2*b*, second face 20 of lens block B has a concave surface, preferably matching a selected nominal base curve. Preferably there is a plurality of blocks B, each having a face 20 matching a selected nominal base curve. Face 20 accommodates a range of front curves of lens blanks which, as best illustrated in FIG. 3, are secured thereto for generating and fining/polishing. A nominal base curve, rather than an exact size, is cut into lens block B, because lens blanks are initially molded or cut by several manufacturers using different machines having different tolerances. Additionally, because a relatively thick adhesive pad A is used to secure lens block B to lens blank L, it is not necessary that the curve cut in second face 20 exactly match the curve of lens blank L.

A blocked lens is best shown in FIG. 3. As can be seen, lens block B is secured to front face 22 of lens blank L by adhesive pad A. In the generating process, the optical laboratory grinds or generates the base and cross curves onto back face 24 of lens blank L. In this process, the blocked lens of FIG. 3 is held in the generating machine by a collet which grabs circumferential edge 18. Chuck centering pins engage holes 14 to maintain the axial position of the lens L during generating. Lens blank L is rotated in the generating machine and a grinding or cutting tool is brought into contact with back face 24 to cut the base and cross curves. Engagement of the tool with face 24 applies a torque to lens blank L which must be resisted by pad A in order for lens blank L to remain secured during the generating process.

In order to maintain back face 24 in the proper vertical reference plane during the generating process, a fiber ring, not shown, is slipped over block B before the blocked lens is inserted into the generating collet. When the blocked lens is inserted into the generating collet, one edge of the fiber ring contacts front face 22 of lens blank L while the opposite edge of the fiber ring contacts the collet. In this way, the lens blank is maintained in the proper vertical plane with respect to the grinding machine, and the reference distance from the collet to front face 22 is known. The fiber ring also provides stability for the lens during the generating process and allows the generator to grind accurate curves without the lens flexing on the adhesive pad.

Adhesive pad A is a double-sided adhesive pad. An adhesive pad suitable for use in the present invention is a double-coated foam-type pad supplied by Adhesive Research, Inc. of Glenrock, Pa. The substrate of adhesive pad A is a multipolymer blend cellular foam material. Oppositely disposed faces 26 and 28 of adhesive pad A have a pressure sensitive, acrylic based, adhesive material applied thereto for securing lens block B to lens blank L. Adhesive pad A, including the substrate and adhesive, has an overall thickness of approximately 1/32 inch. Pad A is thick enough to provide uniform adhesion for bifocal and aspheric front surfaces of lens blank L. The adhesive is characterized by a high resistance to torque to prevent untimely deblocking during the generating process, and a low resistance to shear to allow the lens block and lens blank to be separated.

Figure 4B:
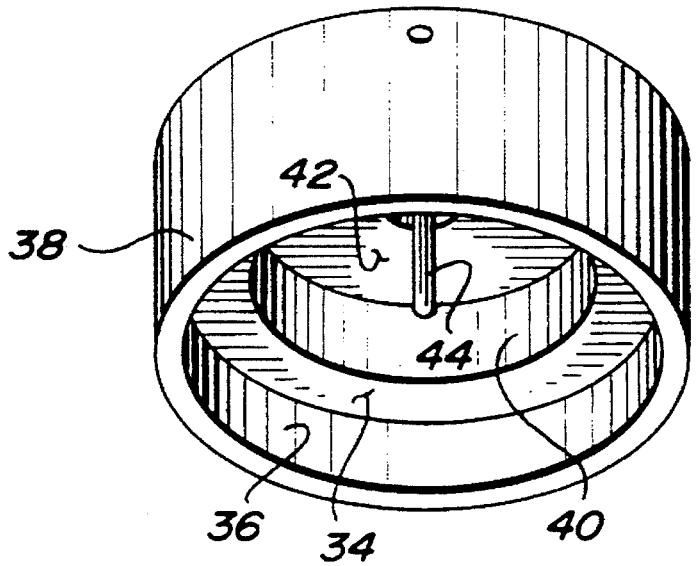
FIG. 4*b* is a bottom perspective view of the fining/polishing collar.

The fining/polishing collar C of the present invention is best shown in FIGS. 4*a* and 4*b*. Collar C is a cylindrical block having a planar first face 30. Diametrically opposed contacts 32 extend in parallel normal from face 30. While collar C may be manufactured from metal or plastic, contacts 32, which engage the pins of the cylinder machine, are hardened steel inserts to prevent premature wear. The second face 34 of collar C is characterized by an outwardly extending ring 36 and a well 40.

Ring 36 extends around the circumference of face 34 from the circumferential edge 38 of collar C. Preferably, a compressible O-ring 41 is secured to ring 36, as by adhesive, press fit or other means well known to those skilled in the art, such that a portion of O-ring 41 extends beyond surface 43 of ring 36. When collar C is placed over lens block B, as best shown in FIG. 1, O-ring 41 contacts front face 22 of lens blank L, thereby uniformly transferring the force of the cylinder machine pins to the lens L without causing adhesive pad A to be compressively deformed. Deformation of adhesive pad A is undesirable during the fining and polishing steps because the surface 24 may become wavy proximate the periphery of blank L. This waviness is believed to occur because compression of pad A occurs most as the lens L moves over lap P. O-ring 41 spreads out the area of contact to alleviate this waviness. Ring 36 is radially outwardly spaced from lens block B and adhesive pad A to increase the area of contact between collar C and lens blank A. This reduces the pressure transmitted from collar C to lens blank L, thereby further reducing the waviness.

Well 40 is circular and accepts lens block B. Well 40 is cut into collar C to a sufficient depth based upon the nominal base curve 22 so that back face 42 does not contact lens block B, thereby preventing deformation of adhesive pad A.

In order to maintain collar C on axis during the fining and polishing process, roll pin 44 is inserted within well 40, as best shown in FIG. 4*a*, at a vertical height adjacent back face 42. Thereby, when collar C is slipped over lens block B, roll pin 44 rests in slot 16 and prevents block B from rotating relative to collar C during the fining and polishing process. Roll pin 44 does not, however, press down on lens block B. Roll pin 44 maintains axial stability between collar C and lens block B, and does not transfer pressure from the cylinder pins to lens block B.

While I show pin 44 and slot 16 as a means for mechanically coupling collar C to lens block B, other arrangements such as a ball and detent, a set screw, or other means as known to those skilled in the art, may be employed.

With collar C, it is now possible to perform both the generating and the fining and polishing processes using a lens block secured to a lens blank by a relatively thick, 1/32 inch, adhesive pad. Without collar C, it was not possible to utilize an adhesively secured lens block for fining and polishing because the motion of the machine would cause the pad to deform, thereby adversely affecting the optics of the lens L. The collar C provides the necessary stability to allow use of an adhesive pad for fining and polishing. Another benefit of collar C is that a relatively thick pad permits the same lens block B to be used within a range of base curves and also to adhere to irregular fronts, such as bifocals, progressives, and aspherics.

In the manufacture of prescription lenses, the operator places double-coated adhesive pad A on lens block B and then mounts block B in a blocker. The blocker, not shown, provides a reference grid to position lens blank L and places lens block B on lens blank L at a particular axis as specified by a surface ticket. The blocked lens, as best shown in FIG. 3, is then generated using the fiber ring to provide stability.

Following the generating process, the blocked lens is removed from the generating machine. A nominal size fining/polishing collar C is selected and placed over lens block B. The assembly is then placed on the cylinder machine for fining and polishing. Finally, the assembly is removed from the machine, collar C is lifted off lens block B, and lens block B and adhesive pad A are separated from lens blank L.

While this invention has been described as having a preferred embodiment, it is to be understood that the invention is capable of further modification, uses, and/or adaptations which follow in general the principle of the invention and includes such departures from the present disclosure as come within known or customary practice in the art to which the invention pertains, and as may be applied to the central features hereinbefore set forth, and fall within the scope of limits of the appended claims.

I claim:

1. A device for transmitting rotational force to a lens from a machine during the generating, fining, and polishing of a lens, the device comprising:

a cylindrical block (B) having first and second oppositely disposed faces and a circumferential wall (18) of substantially constant thickness extending therebetween, said first face (12) being substantially planar across its entire diameter and said second face (20) defining an arc across its entire diameter for mating with the lens (L), said first face (12) of said cylindrical block defining a pair of pin locating holes (14) for engaging chuck centering pins of a generating machine which maintain the axial position of the lens (L) during generating, each of said pin locating holes (14) having a metal insert (15) disposed therein to protect the block from excessive wear;

a pin slot (16) defined in said first face of said block, said pin slot extending diametrically across said first face through said pin locating holes (14) so as to open at said circumferential wall (18) on opposite sides of said block, said pin slot (16) being defined in said first face (12) such that the depth of said pin locating holes (14) is substantially greater than the depth of said pin slot;

a double-sided adhesive pad (A) adhered to the second face (20) of said block so as to be disposed directly between said block and the lens, said double-sided adhesive pad having a substrate and opposing faces having pressure sensitive adhesive material applied thereto for securing the lens to said block;

a cylindrical collar (C) coupled to said block for surrounding and engaging said block during fining and polishing of the lens, said collar having an outer planar face (30) and an opposing inner face (34), said inner face (34) of said collar for engaging said first face (12) of said block, said collar including a pair of diametrically opposed contacts (32) of hardened steel protruding from said outer face for engaging pins of a cylinder machine during fining and polishing of the lens, said contacts being radially spaced from said pair of pin locating holes defined in said block when said collar and said block are engaged;

a compressible O-ring disposed around the circumference of said inner face (34) of said collar for contacting the lens so as to uniformly transfer rotating force to the lens without causing said adhesive pad to be compressively deformed;

a diametrically extending roll pin (41) affixed to said inner face of said collar in a manner such that said roll pin rests in said pin slot (16) of said block when said collar and said block are engaged adjacent the lens, whereby said roll pin maintains the position of said collar relative to said block and the lens during the fining and polishing processes; and wherein said inner face of said collar has a diametrically terraced or stepped surface including a plurality of substantially parallel levels so that the central area of said inner face engages said first face (12) of said block and the outer area of said inner-face is closer to the lens and engages said O-ring.

2. The device of claim 1, wherein said roll pin (44) is parallel to said outer face of said collar and rests in said pair of pin locating holes defined in said block when said roll pin rests in said pin slot (16).

3. The device of claim 2, wherein said pin locating holes in said block are covered and thus become inaccessible when said collar is positioned for engaging and surrounding said block during the fining and polishing process.

4. The device of claim 3, wherein said substrate of said pad is a multipolymer blend cellular foam substrate and said adhesive material is acrylic based.

* * * * *